US009464778B2

(12) United States Patent
Yuan et al.

(10) Patent No.: US 9,464,778 B2
(45) Date of Patent: Oct. 11, 2016

(54) LIGHTING DEVICE UTILIZING A DOUBLE FRESNEL LENS

(71) Applicant: Cree, Inc., Durham, NC (US)

(72) Inventors: Zongjie Yuan, Libertyville, IL (US); Kurt S. Wilcox, Libertyville, IL (US); Benjamin P. Beck, Union Grove, WI (US); Lisa Marie Barglind, Niagara, WI (US); Steven Patkus, Mount Pleasant, WI (US); William Herschel Couch, Wake Forest, NC (US)

(73) Assignee: Cree, Inc., Durham, NC (US)

( * ) Notice: Subject to any disclaimer, the term of this patent is extended or adjusted under 35 U.S.C. 154(b) by 120 days.

(21) Appl. No.: 14/527,405

(22) Filed: Oct. 29, 2014

(65) Prior Publication Data

US 2015/0204491 A1 Jul. 23, 2015

Related U.S. Application Data

(60) Provisional application No. 61/929,905, filed on Jan. 21, 2014.

(51) Int. Cl.
*F21V 5/00* (2015.01)
*F21V 5/04* (2006.01)

(52) U.S. Cl.
CPC ..... *F21V 5/007* (2013.01); *F21V 5/045* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,158,222 | A * | 6/1979 | Cook | F21V 5/02 359/742 |
| 5,097,258 | A | 3/1992 | Iwaki | |
| 6,241,363 | B1 | 6/2001 | Lee | |
| 7,072,096 | B2 | 7/2006 | Holman et al. | |
| 7,106,528 | B2 | 9/2006 | Ohmori et al. | |
| 7,581,854 | B2 | 9/2009 | Ford | |
| 7,648,256 | B2 | 1/2010 | Shiratsuchi et al. | |
| 7,750,982 | B2 | 7/2010 | Nelson et al. | |
| 7,857,619 | B2 | 12/2010 | Liu | |
| 2011/0007505 | A1 | 1/2011 | Wang | |
| 2012/0067418 | A1 | 3/2012 | Hornung | |

FOREIGN PATENT DOCUMENTS

| | | |
|---|---|---|
| DE | 102006013343 | 9/2007 |

* cited by examiner

*Primary Examiner* — Stephen F Husar
(74) *Attorney, Agent, or Firm* — McCracken & Gillen LLC

(57) ABSTRACT

According to one aspect, an optical lens includes a substrate having a first side and a second side opposite the first side. The optical lens includes a first pattern of Fresnel features having a first focal length disposed on the first side and a second pattern of Fresnel features having a second focal length disposed on the second side. The first pattern of Fresnel features is disposed perpendicular to the second pattern of Fresnel features, and the first focal length is different from the second focal length.

21 Claims, 18 Drawing Sheets

LIGHTING DEVICE UTILIZING A DOUBLE FRESNEL LENS

CROSS REFERENCE TO RELATED APPLICATIONS

This application claims the benefit of Provisional Patent Application No. 61/929,905, filed on Jan. 21, 2014, which is hereby incorporated by reference in its entirety.

REFERENCE REGARDING FEDERALLY SPONSORED RESEARCH OR DEVELOPMENT

Not applicable

SEQUENTIAL LISTING

Not applicable

FIELD OF THE DISCLOSURE

The present subject matter relates to solid state lighting devices, and more particularly, to optic systems thereof.

BACKGROUND

Solid state light emitters including organic, inorganic, and polymer light emitting diodes (LEDs) may be utilized as an energy-efficient alternative to more traditional lighting systems. Many modern lighting applications utilize high power solid state emitters to provide a desired level of brightness.

A lighting device typically includes a reflector and a diffuser to direct light emitted from the solid state emitters. The reflector is made of a reflective material, such as aluminum or silvered plastic. The shape of the reflector in combination with the diffuser and LED array size, array configuration, and relative location of the array to other optical components produces a specific beam spread. The beam spread is the volume of space defined by the generally frusto-conical locus of points at which the intensity of the light is equal to 50% of the maximum lumen output. The beam spread determines the coverage of a single lighting unit as well as the spacing and quantity required when a plurality of such units are used for uniform illumination of a surface.

The use of point sources such as an LED, in some instances, however, can cause undesirable glare due to the uncontrolled angular distribution of light emitted from the lighting device. One way of controlling the angular spread of light emitted from each LED is to fit each source with a dedicated lens, referred to herein as a "primary lens." These lenses can be disposed with an air gap between the lens and the light source, or may be manufactured separately from a suitable optical grade material such as acrylic, molded silicone, polycarbonate, glass, and/or cyclic olefin copolymers, and combinations thereof. Primary lenses allow numerous advantages such as higher efficiency coupling, controlled overlap of light flux from the sources, and angular control of the emitted light.

A way to further control the angular distribution and/or mix color LED arrays is to utilize an additional lens(es), referred to herein as a "secondary lens(es)," separate from the LED array. In a light device that includes a plurality of different colored LEDs, the secondary lens may provide angular control of the emitted light to further promote mixing and to avoid separate color non-uniformity.

Fresnel lenses are well-known in the art to utilize refractive optical surfaces to direct and collimate the light. The angular distribution of the light emitted from the lens is determined primarily by the index of refraction of the lens material, the focal length of the lens, and the distance between the light source and the lens, although other factors may be more determinative depending on the circumstances. The focal length of a lens is a function of the angles of the combined curved surfaces, and is the distance between the light source (or focus point) and the lens such that the light emitted from the light source is optimally collimated.

SUMMARY

According to one aspect, an optical lens comprises a substrate comprising a first side and a second side opposite the first side. The optical lens comrises a first pattern of Fresnel features comprising a first focal length disposed on the first side and a second pattern of Fresnel features comprising a second focal length disposed on the second side. The first pattern of Fresnel features is disposed perpendicular to the second pattern of Fresnel features, and the first focal length is different from the second focal length.

According to a second aspect, a lighting device comprises a housing, an LED array disposed in the housing, and an optical lens disposed adjacent to the LED array. The optical lens comprises a substrate comprising a first pattern of Fresnel features disposed on a first side of the substrate and a second pattern of Fresnel features disposed on a second side of the substrate opposite the first side. The first pattern of Fresnel features is perpendicular to and different from the second pattern of Fresnel features.

According to another aspect, a lighting device module comprises a housing module and an LED array disposed in the housing module and comprising an array of LEDs. The lighting device module comprises an optional lens and a distributed lens disposed between the LED array and the optical lens. The LED array, the optical lens, and the distributed lens are self-contained within the housing module.

Other aspects and advantages of the present invention will become apparent upon consideration of the following detailed description and the attached drawings wherein like numerals designate like structures throughout the specification.

DETAILED DESCRIPTION

Figure 1:
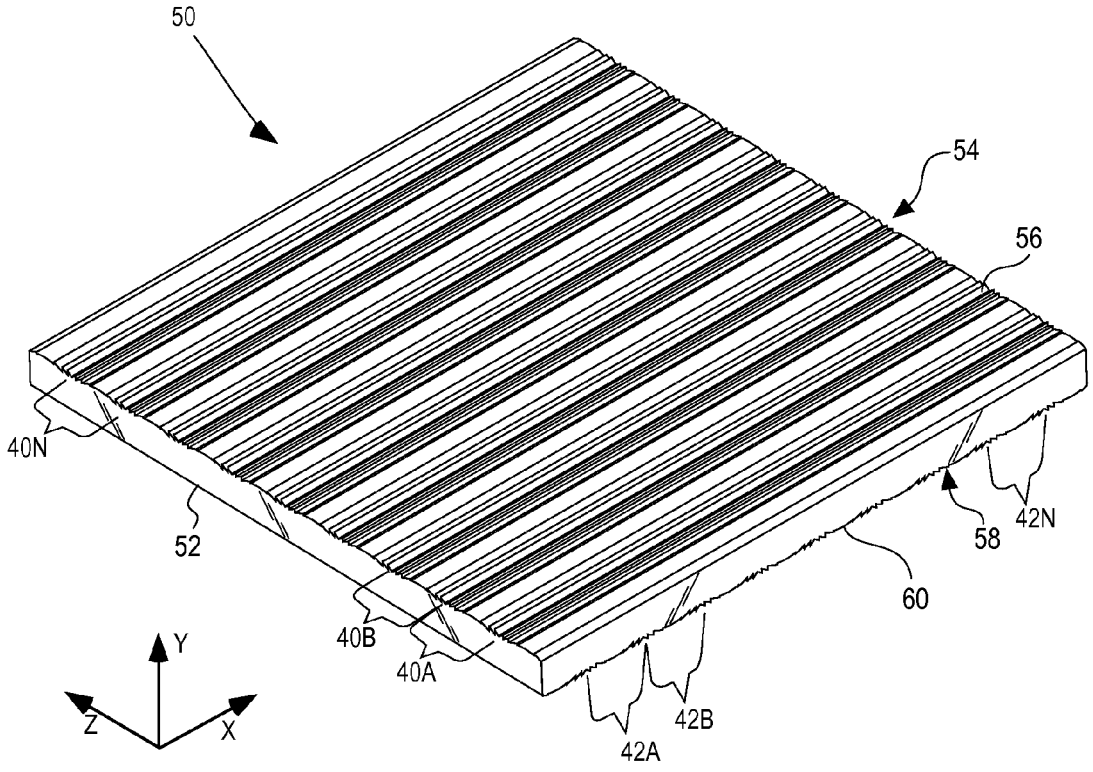
FIG. 1 is an isometric view of a double Fresnel lens.
Figure 1A:
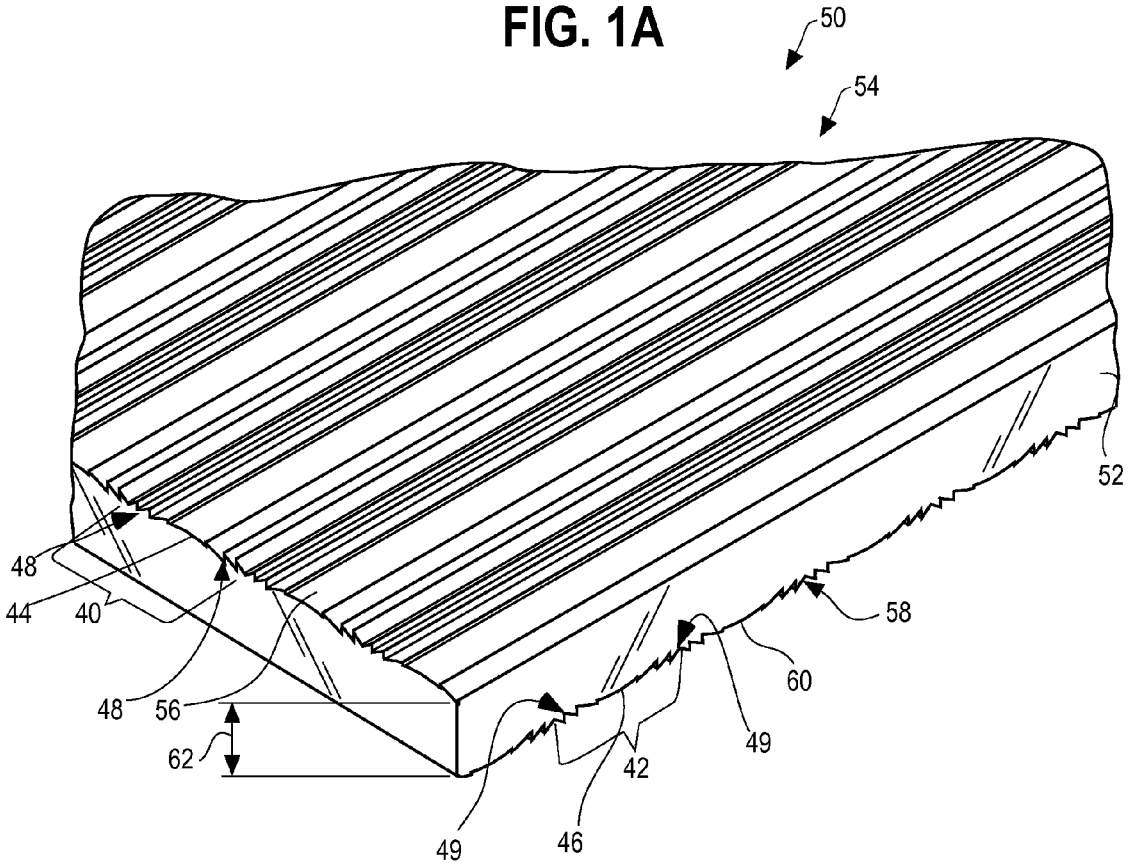
FIG. 1A is an enlarged view of a portion of the double Fresnel lens of FIG. 1.
Figure 4:
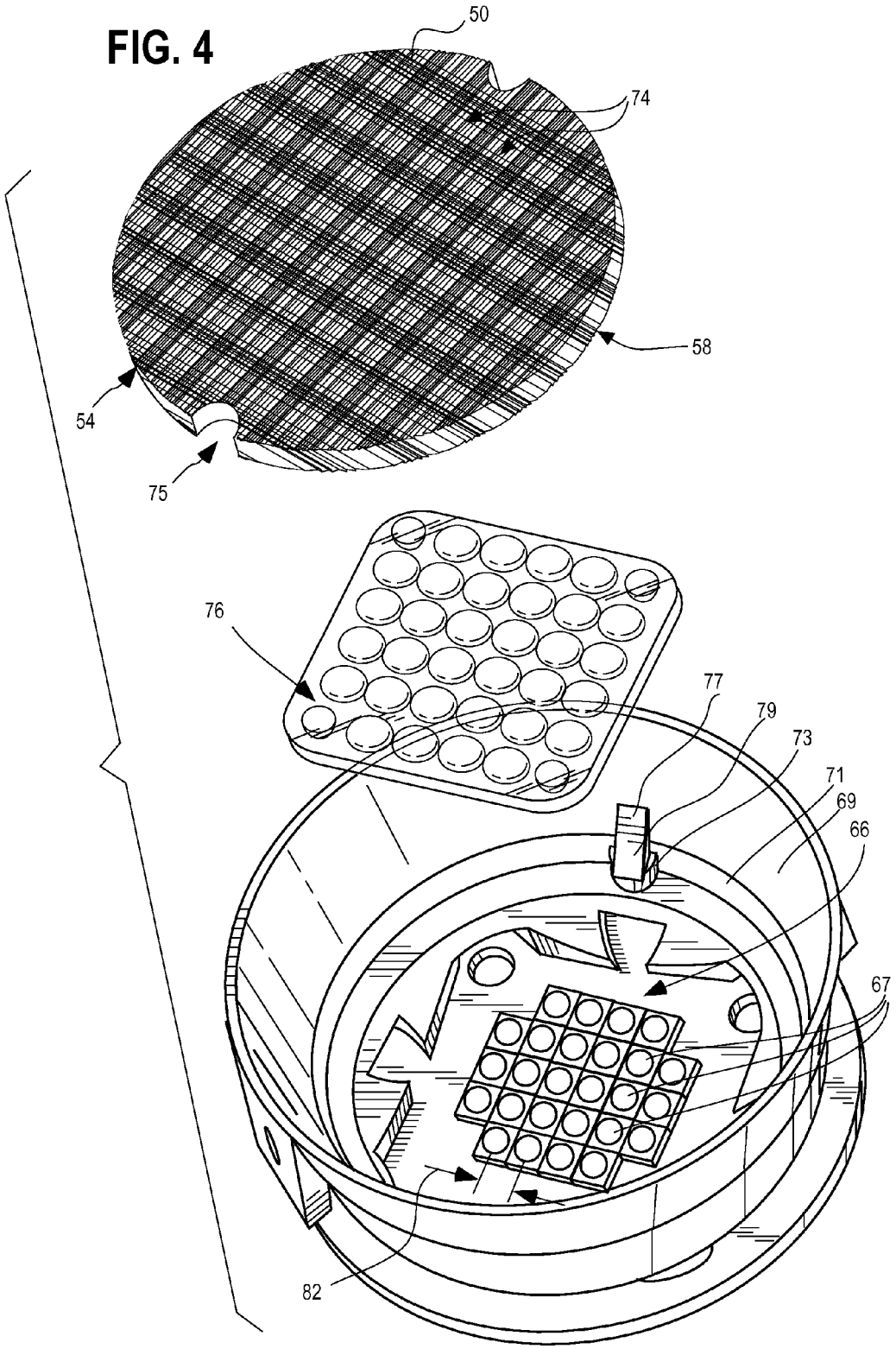
FIG. 4 is an exploded, isometric view of the lighting device of FIG. 3 with a distributed lens array.

Referring to FIG. 1, one embodiment of a double Fresnel lens 50 is shown. The double Fresnel lens 50 comprises a translucent substrate 52 having a thickness 62 with a first pattern of Fresnel features 54 on a first surface 56 and a second pattern of Fresnel features 58 on a second surface 60 opposite the first surface 56. While the double Fresnel lens 50 shown in FIGS. 1-2A has a generally square shape, other geometries may selectively be employed, for example, a circular shape as shown in FIG. 4. The first pattern of Fresnel features 54 includes one or more units 40A, 40B, . . . , 40N of Fresnel features, and the second pattern of Fresnel features 58 includes one or more units 42A, 42B, . . . , 42N of Fresnel features. As best shown in FIG. 1A, each unit 40A, 40B, . . . , 40N of Fresnel features includes a convex lens 44 and each unit 42A, 42B, . . . , 42N of Fresnel features includes a convex lens 46. Disposed on opposite sides of the convex lenses 44 and 46 are shifting cut sections of convex lenses 48 and 49, respectively. The shifting cut sections of convex lenses 48 and 49 minimize the total thickness of the double Fresnel lens 50 while maintaining optical performance.

The first pattern of Fresnel features 54 may be the same or different from the second pattern of Fresnel features 58. More specifically, convex lenses 44 and shifting cut sections of convex lenses 48 may have the same profile as convex lenses 46 and shifting cut sections of convex lenses 49 or they may be different. In the illustrated embodiment, the first pattern of Fresnel features 54 is different from the second pattern of Fresnel features 58.

Figure 2:
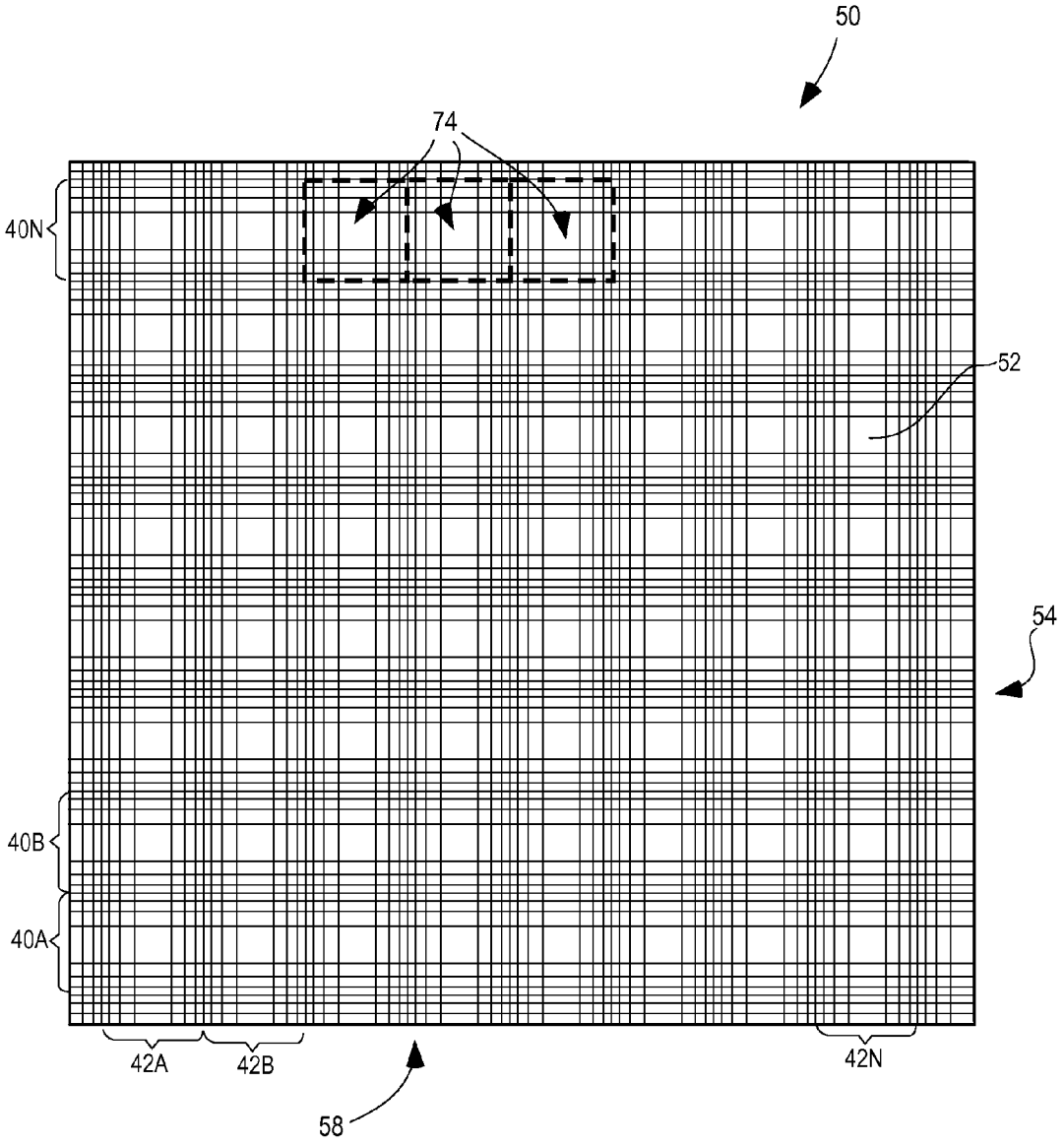
FIG. 2 is a plan view of the double Fresnel lens of FIG. 1 showing the crossing pattern of the Fresnel features.

As seen in the example embodiment of FIG. 1, the units 40 of Fresnel features of the first pattern 54 extend linearly across the translucent substrate 52 in the X-direction and repeat uniformly across the translucent substrate in the Z-direction, and the units 42 of the Fresnel features of the second pattern 58 extend linearly across the substrate in the Z-direction and uniformly repeat across the substrate in the X-direction. Thus, the first and second patterns of Fresnel features 54, 58 are disposed perpendicular to one another and are separated by the thickness 62 of the double Fresnel lens 50. Arranging the first and second patterns of Fresnel features 54, 58 in this manner creates a crossing pattern of Fresnel features as best shown in FIG. 2. While the first and second patterns of Fresnel features 54, 58 in the example embodiments shown in the figures are linear, other geometries may be used (e.g., circular).

Figure 2A:
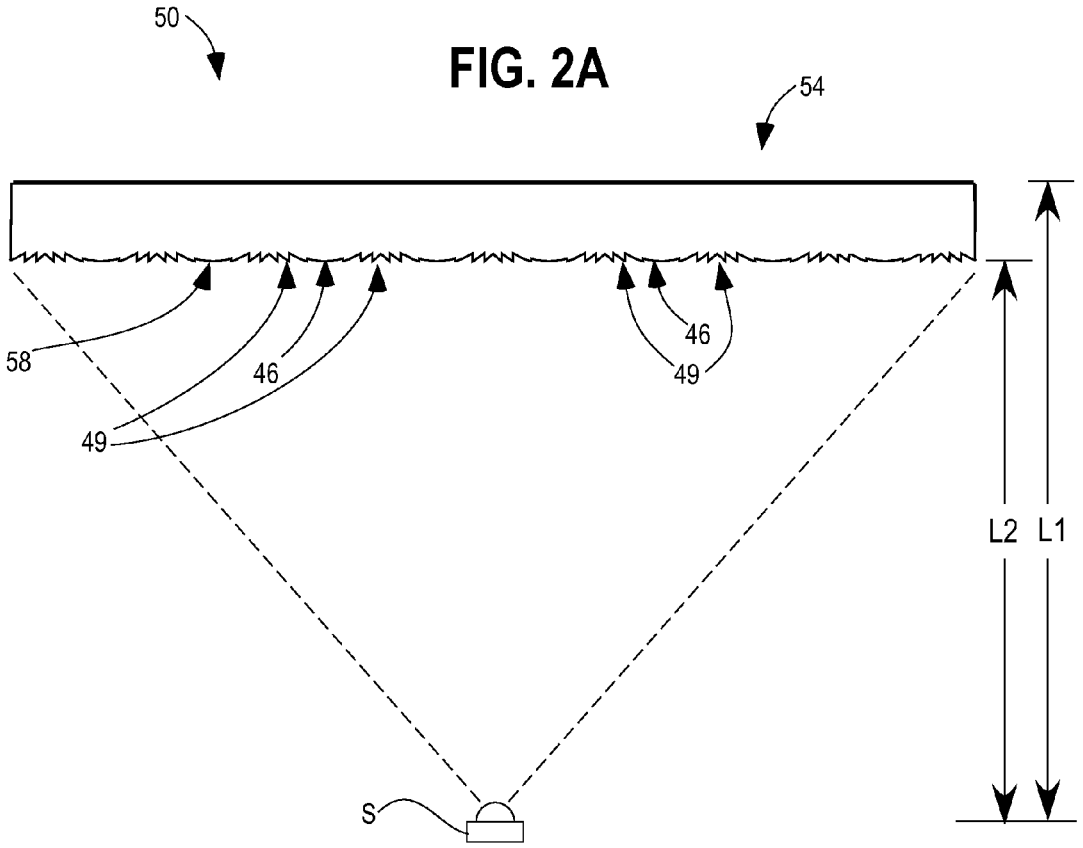
FIG. 2A is a side elevational view of the double Fresnel lens of FIG. 1.

Turning to FIG. 2A, in one embodiment, the first pattern of Fresnel features 54 of the double Fresnel lens 50 has a first focal length L and the second pattern of Fresnel features 58 has a second focal length L2, different from the first focal length L1. The first focal length L1 is a function of the angles of the combined curved surfaces of the first pattern of Fresnel features 54 (i.e., convex lenses 44 and shifting cut sections of convex lenses 48), and is the distance between the first pattern of Fresnel features 54 and a light source S such as an LED or an array of LEDs (see FIG. 3). Likewise, the second focal length L2 is a function of the angles of the combined curved surfaces of the second pattern of Fresnel features 58 (i.e., convex lenses 46 and shifting cut sections 49), and is the distance between the second pattern of Fresnel features 58 and the light source S.

Figure 3:
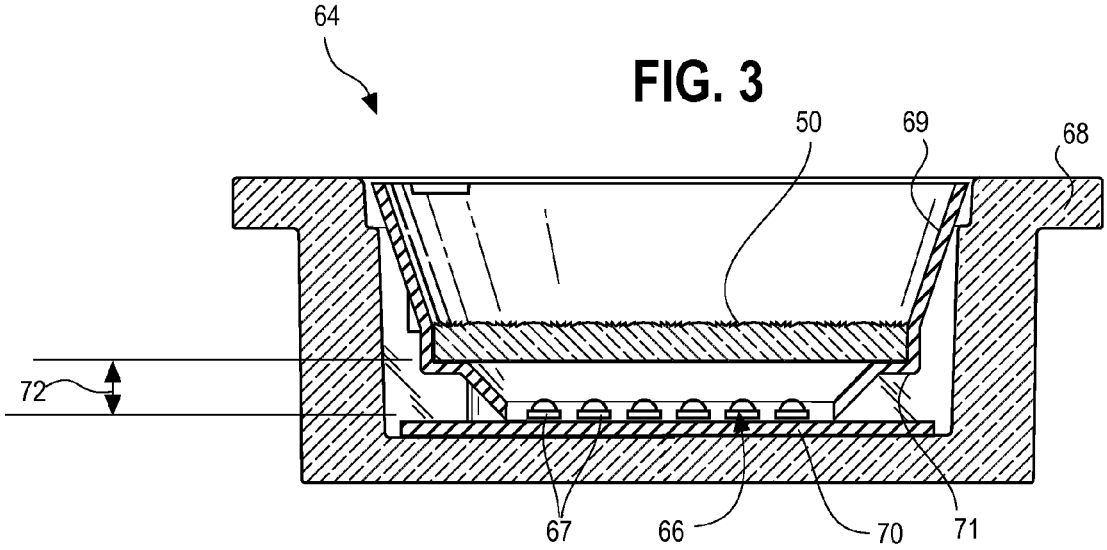
FIG. 3 is a sectional view of a lighting device.

Referring to FIG. 3, one embodiment of a lighting device 64 is shown. The lighting device 64 includes the double Fresnel lens 50 spaced apart from an LED array 66 within a housing 68. The double Fresnel lens 50 is disposed at a distance 72 from the LED array 66. In this example embodiment, the double Fresnel lens 50 has a circular shape (see FIG. 4). The LED array 66 may include LEDs of a single color, or may include a multi-color LED component having, for example, one or more red LEDs with one or more blue-shifted yellow LEDs.

The housing 68 may include a frustoconically shaped inner member 69 centered about the LED array 66. The LED array 66 is disposed on a printed circuit board (PCB) 70. In one embodiment, the inner member 69 includes a circular flange 71 upon which the double Fresnel lens 50 is disposed. The inner member 69 may include one or more protrusions 73 disposed above the flange 71 as shown in the embodiment of FIG. 4. The protrusion 73 is used to prevent the double Fresnel lens 50 from spinning or moving laterally when the double Fresnel lens 50 is mounted on the flange 71 of the inner member 69. While the protrusion 73 may have a half-moon shape as shown in FIG. 4, other geometric shapes may be used. The shape of the protrusion 73 corresponds to a similarly shaped half-moon cut-out portion 75 of the double Fresnel lens. When the double Fresnel lens 50 is placed on the flange 71, the cut-out portion 75 engages the protrusion 73.

The inner member 69 may also include a lock mechanism 77 (see FIG. 4) to prevent the double Fresnel lens 50 from moving away from the flange 71 once the double Fresnel lens 50 is mounted on the flange 71. For example, if the lighting device 64 is mounted such that the light from the LEDs shines down, then the lock mechanism 77 will prevent the double Fresnel lens from falling off of the flange 71. In one embodiment, the lock mechanism 77 is a push and release latch 79. When the double Fresnel lens is being mounted on the flange 71, the latch 79 is compressed against the inner member 69 so that the lens can move past the latch.

Once the lens is in place, then the latch 79 is released so that it protrudes past the protrusion 73, thereby locking the lens in place.

As shown in FIG. 3, the double Fresnel lens 50 is disposed at a distance 72 from the LED array 66. The LED array 66 may include LEDs of a single color, or may include a multi-color LED component having, for example, one or more red LEDs with one or more blue-shifted yellow LEDs.

The crossing first and second patterns of Fresnel features 54, 58 of the double Fresnel lens 50, which are formed by the perpendicular arrangement of the repeating units 40 and 42 of Fresnel features, create a grid-like array of lenslets 74 (see dotted lined sections of FIG. 2). In one embodiment, the LEI) array 66 is a linear matrix with spacing of the individual LEDs being equal to and in alignment with the lenslets 74 of the double Fresnel lens 50. Other embodiments may include an LED array having varied spacing.

To optimize the collimation and mixing of the light, the following four parameters are dependent upon one another and factored into the design: the focal length L1 of the first pattern of Fresnel features 54, the focal length L2 of the second pattern of Fresnel features 58, the pitch 81 (see FIG. 5) of the first and second patterns of Fresnel features 54, 58, where the pitch is the distance between the center points of adjacent convex lenses 44 and 46 of respective units of Fresnel features 40 and 42, and the distance 72 between the LED array 66 and the double Fresnel lens 50. The focal lengths L1 and L2 of the respective first and second patterns of Fresnel features 54, 58 may range between about 3 millimeters and about 10 millimeters. In this example, the pitch 81 of the first and second patterns of Fresnel features 54, 58 may be the same as the spacing 82 between the center points of the individual LEDs 67 in the LED array 66 (see FIG. 5) and may range between about 6 millimeters and about 12 millimeters. The focal lengths L1 and L2 may also relate to the light source spacing distances. For example, the focal lengths L1 and L2 may range from 0.50 to 2.0 times the spacing distance 82 between the LEDs 67 in the array 66. The distance 72 may range between about 5 millimeters and about 12 millimeters. The distance 72 between the LED array 66 and the double Fresnel lens 50 may also relate to the light source (e.g. LED) spacing distances. In this example embodiment, the distance 72 between the LED array 66 and the double Fresnel lens 50 may range from 0.50 to 2.0 times the spacing distance 82 between the LEDs 67 in the LED array 66. Under some example embodiments, it has been found that the use of the double Fresnel lens may increase the optical efficiency of a lighting device by about 5% or more.

Varying the first and second focal lengths L1, L2 of respective first and second patterns of Fresnel Features 54, 58 and the distance 72 between the LED array 66 and the double Fresnel lens 50 may achieve varied levels of color mixing and beam angle collimation. The resulting collimated beam may have a spread of from about 10 degrees to about 50 degrees. Increasing the distance 72 between the LED array 66 and the double Fresnel lens 50 minimizes stray light, but also results in a narrower beam spread of collimated light.

In some circumstances, it may be desired that the first and second patterns of Fresnel features 54, 58 have the same profile, although such patterns would not optimize collimation of the light. In other embodiments, the profile of the first and second patterns of Fresnel features 54, 58 may differ, for example, to account for the thickness 62 of the double Fresnel lens 50.

Figure 5:
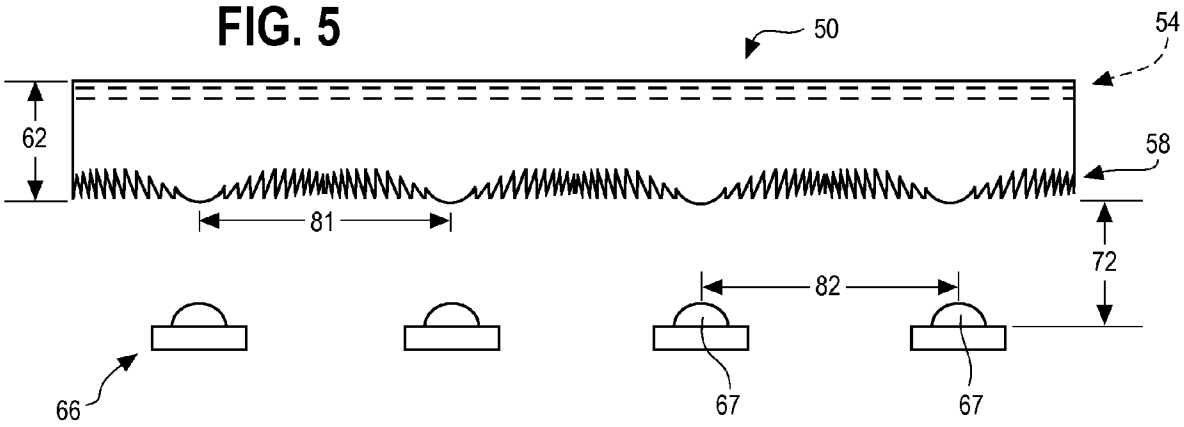
FIG. 5 is a schematic view of the double Fresnel lens and an LED array.

In the example embodiment shown in FIG. 4, the number of the lenslets 74 and the size of the lenslets 74 of the double Fresnel lens 50 correspond to the number and emission surface area of the LEDs 67 in the LED array 66, and the center of the lenslets 74 are aligned with the center of the LEDs 67. Such an arrangement produces a collimated beam with sufficient color mixing. Specifically, FIG. 5 schematically illustrates the alignment of the LEDs 67 of the LED array 66 with the second pattern of Fresnel features 58 of the double Fresnel lens 50, and the LEDs 67 may be similarly aligned with the first pattern of Fresnel features 54 to produce a sufficiently mixed and collimated beam spread. Such alignment tends to minimize the appearance of dark and light areas that result from a lateral offset of the lenslets 74 and LEDs 67 of the LED array 66. In other embodiments, it may be desirable to have different sizes and numbers of lenslets 74 and LEDs 67 and/or a lateral offset thereof to produce a desired beam spread and light distribution.

Figure 6A:
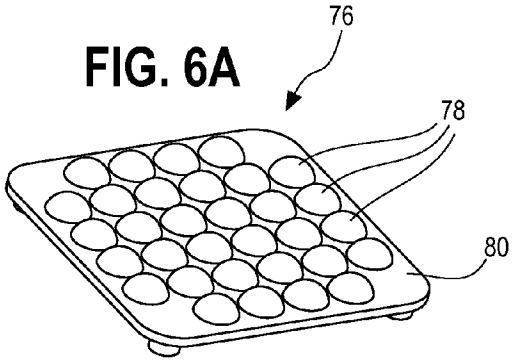
FIG. 6A is an isometric view of the distributed lens array of FIG. 6.
Figure 6:
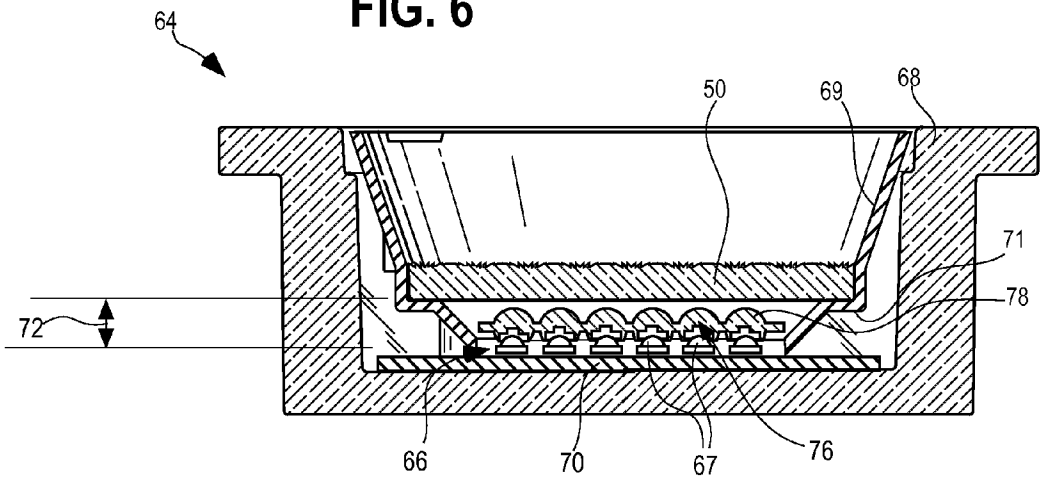
FIG. 6 is a sectional view of the lighting device with a distributed lens array.

In the embodiments shown in FIGS. 4 and 6, the light device 64 includes an additional secondary lens referred to as a "distributed lens array" 76 positioned adjacent to the LED array 66 to minimize stray light. As seen in FIGS. 6 and 6A, the distributed lens array 76 includes a plurality of curved lenses 78 that extend from a base plate 80 and receive the individual LEDs 67 of the corresponding LED array 66. The curved lenses 78 may have a circular, hemispherical or other curved shape. The distributed array 76 may, for example, be a refraction lens to provide control over the emitted light with generally symmetrical design of lenses 78 allowing for desired light distribution. The distributed lens array 76 may be positioned directly against the LED array 66 such that an air gap is not formed, or an air gap (not shown) may be maintained between the distributed lens array 76 and the LED array 66, depending on the desired effect. In some embodiments, the lenses 78 of the distributed lens array 76 have a radius of between about 1.5 millimeters and about 4.0 millimeters. Additionally, in some embodiments the curved lenses 78 of the distributed lens array 76 may have a diameter between 0.2 and 1.0 times the LED spacing of the individual LEDs 67 in the LED array 66.

In addition to use of the distributed lens array 76, stray light may also be minimized by increasing the spacing 82 (see FIG. 5) between the individual LEDs 67 in the LED array 66, by reducing the size of the individual LEDs 67, or by increasing the size of the LED matrix. In some embodiments, an external specular reflector and/or a reflector trim may be used to increase beam spread and/or improve color mixing. In some circumstances, the use of additional components may impact the efficiency of the luminaire.

Simulation analyses of the embodiments shown in FIGS. 3 and 6 were performed to compare color mixing, collimation, and intensity distribution of lighting devices 64 with and without the distributed lens array 76. Such simulation demonstrated that the distributed lens array 76 provides some control over the emitted light such that stray light is minimized, and the color separation outside collimation is reduced.

The double Fresnel lens 50 may be made of any suitable optical grade material including one or more of acrylic, air, molded silicone, polycarbonate, glass, and/or cyclic olefin copolymers, and combinations thereof. The first and second patterns of Fresnel features 54, 58 may be embossed, molded, screen printed, machined, laser-formed, laminated, or otherwise formed and disposed on the first and second surfaces 56, 60 of the double Fresnel lens 50.

Figure 7:
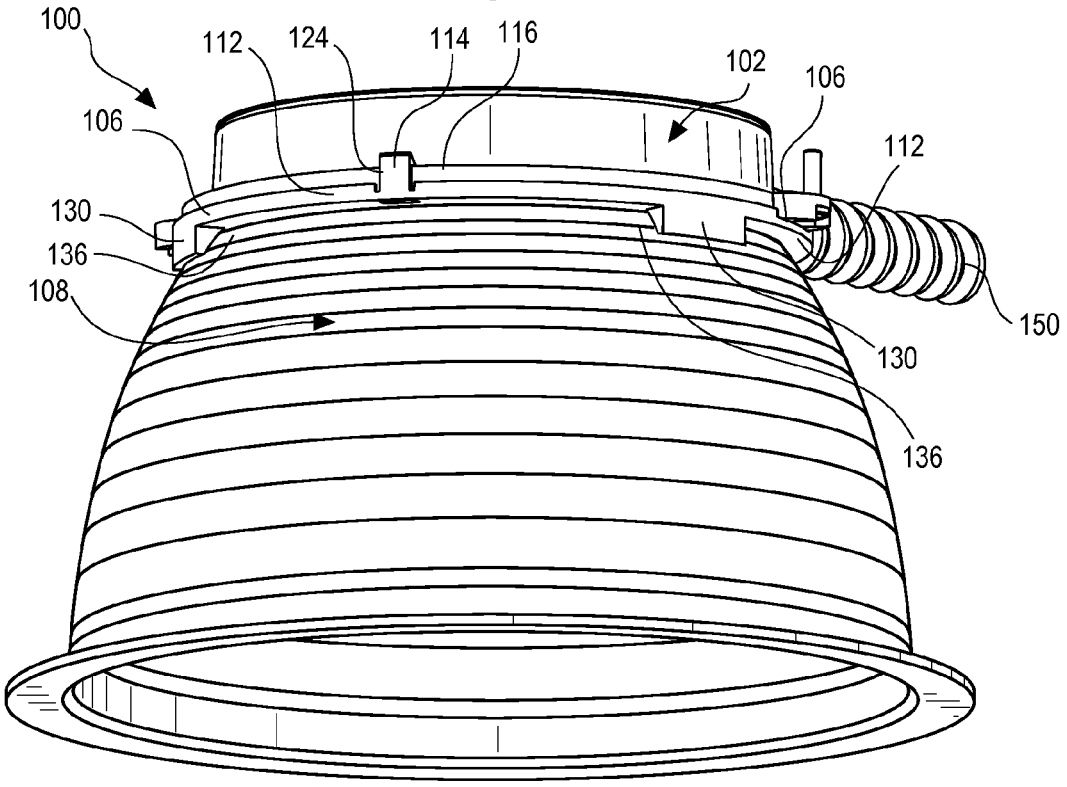
FIG. 7 is an isometric view of one embodiment of a lighting device module positioned atop of a trim member for a recessed fixture.
Figure 8:
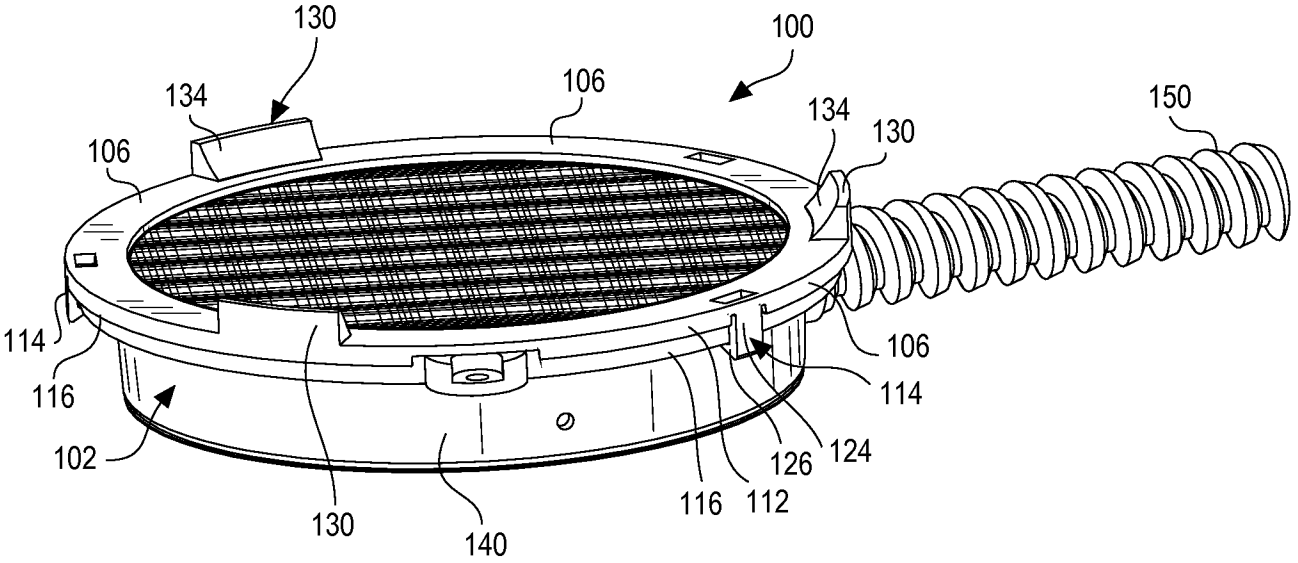
FIG. 8 is an isometric view of the lighting device module of FIG. 7.
Figure 9:
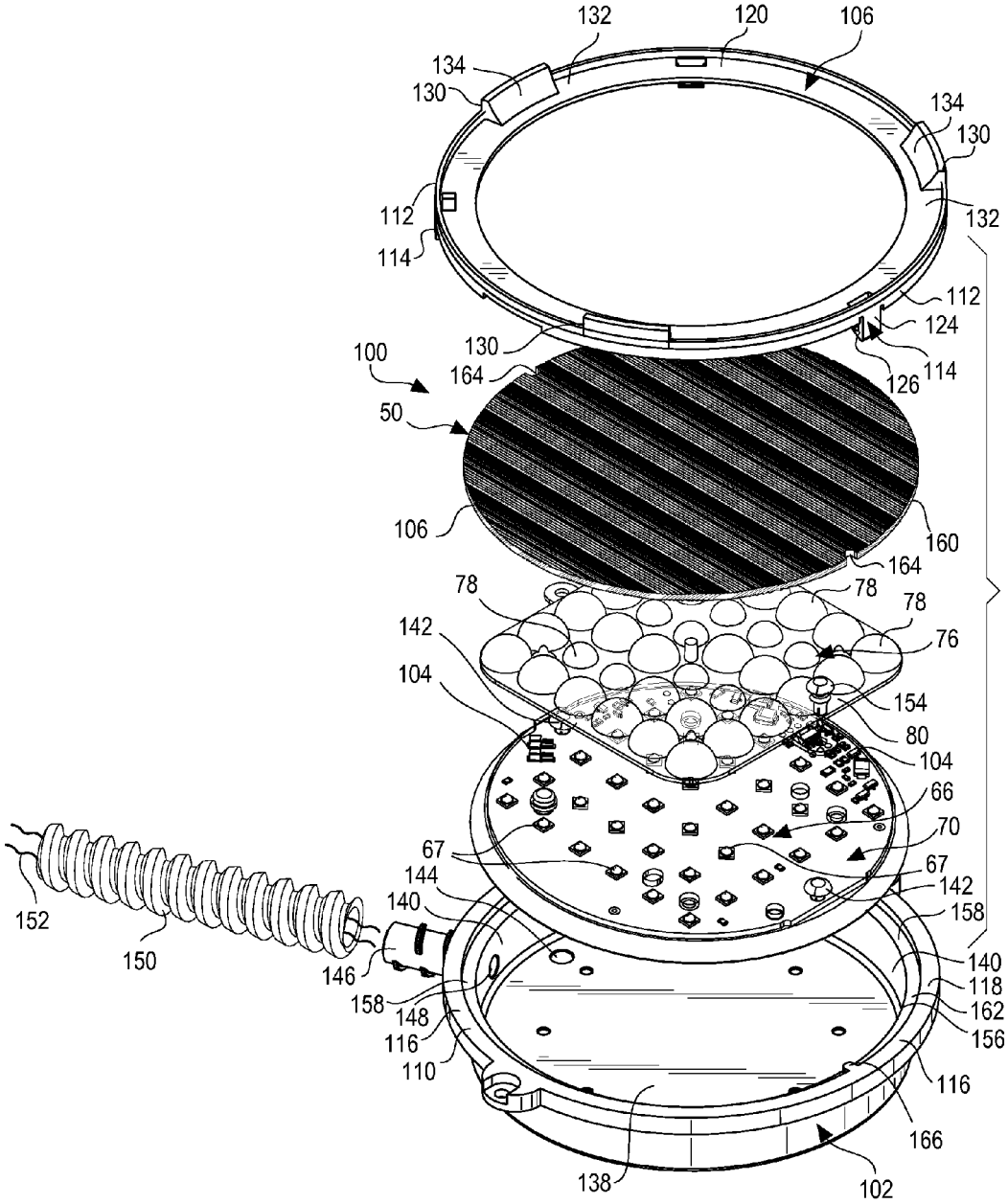
FIG. 9 is an exploded view of the lighting device module of FIG. 7.

Referring to FIGS. 7-9, an example embodiment of a lighting device module 100 utilizing the double Fresnel lens 50 is shown. In this example, the lighting device module 100 includes a housing module 102 for housing a PCB 70 with an LED array 66 of individual LEDs 67, a distributed lens array 76, and double Fresnel lens 50 (FIG. 9). The distributed lens array 76 is disposed between the LED array 66 of the PCB 70 and the double Fresnel lens 50. Electronics 104 mounted on PCB 70 provide operative control and power for the LEDs 67 of LED array 66. PCB 70 (having LEDs 67 and electronics 104), distributed lens 76 and double Fresnel lens 50 are housed within the housing module 102. The electronics 104, LEDs 67, distributed lens array 76, and double Fresnel lens 50 are self-contained in the housing module 102 to produce a compact light engine of the lighting device module 100. The lighting device module 100, in this example, includes an outer cover 106 to retain the double Fresnel lens 50 in the housing module 102.

As seen in FIG. 7, the lighting device module 100 may be aligned with a trim member 108 of a lighting fixture. The self-contained lighting device module 100 may be utilized in a variety of light fixtures such as recessed down lights, or alternatively tracklights, downlights, or flood/area lights and the like. As seen, the lighting device module 100 provides optical control of light from the LEDs 67 through the combination of the distributed lens array 76 and double Fresnel lens 50. Various types of distributed lenses in combination with alternative types of optical Fresnel lenses may selectively be used within the lighting device module. The lighting device module 100 provides for the control of color, light, direction, and beam spread (e.g., narrow, medium, wide) through varying combinations of refraction lenses 76 (or alternatively TIR lenses) and optical Fresnel lenses 50. For example, a narrow beam spread may be used in recessed fixtures for high ceilings to provide sufficient lighting to reach ground level, while medium or wide beam spreads may be selectively employed in various other lighting applications.

As seen in the example embodiment of FIGS. 7-9, the housing module 102 has a generally circular shape with circular shaped cover member 106 fitted about one end 110 of the housing module 102. The double Fresnel lens 50, PCB 70, and base plate 80 of the distributed lens array 76 likewise have a generally circular shape, in this example, for compact filing with the housing module 102. Disposed at discrete locations proximate a periphery 112 of the cover 106 are snap members 114. The snap members 114 are configured to snap fit into engagement with a rim member 116 of the housing module 102 to secure the cover 106 about an outer wall 118 at end 110 of the housing module 102. An interior wall 120 extends from the periphery 112 of the cover 106 to prevent the double Fresnel lens 50 from exiting the open end 110 of the housing module 102. However, a central open area 122 of the cover 106 allows for light rays transmitted through the double Fresnel lens 50 to exit the self-contained lighting device module 100. In this example embodiment, three snap members 114 are spaced approximately equally about the periphery 112 of the cover 106 but, a greater or lesser number of snap members may selectively be employed. The snap members 114 have an extending wall 124 and an angled wall 126 adjacent the extending wall 124. The snap members 114 may be resilient such that the extending wall 124 may move back and snap the angled wall 126 into engagement with the rim 116 of the housing module 102 to secure the cover 106 to the housing module upon the cover 106 being positioned about the rim 116 of the housing module 102. The housing member 102 and cover 106 may be formed of metal, plastic or other suitable material for housing the components of the light device module and providing adequate resiliency for assembly of the module. Also positioned at discrete locations about the housing cover 106 are protrusions 130 that extend from a surface 132 of the interior wall 120 of the cover 106. The protrusions 130, in this example, each have a curved wall 134 that align with curved outer surface 136 of the trim member 108. As seen in FIG. 7, this allows the lighting device module 100 to rest on the trim member 108 with the protrusions 130 of the cover member 106 maintaining the trim member 108 to be centered on the housing module 102.

Referring to FIG. 9, the housing module 102 includes a mounting wall 138 and a vertical sidewall 140 extending therefrom. The PCB 70, having LEDs 67 disposed thereon, is fastened to the mounting wall 138 by push-pins 142 extending through the PCB 70 and secures with a corresponding bore 144 in the mounting wall 138 of the housing module 102. Rivets, screws, fasteners or other suitable securement devices may selectively be used to secure the PCB 70 within the housing module 102. A threaded tube 146 is aligned with and extends from an aperture 148 in the vertical sidewall 140 of the housing module 102. A conduit 150 may be rotated about the threaded tube 146 to secure the conduit 150 to the housing module 102. Wiring 152 may be inserted through the conduit 150 and threaded tube 146 exiting the aperture 148 to connect with the PCB 70.

Referring still to FIG. 9, once the PCB 70 is secured within the housing module 102, the distributed lens array 76 is positioned on top of the PCB 70. The distributed lens array 76, in this example, has a base plate 80 and an array of hemispherical lenses 78 extending from the base plate 80. The hemispherical lenses 78 are aligned to receive respective individual LEDs 67 of the LED array 66 on the PCB 70 in a one-to-one correspondence. In this example, the distributed lens array 76 may be secured to the housing module 102 by push-pins 154 and 142 which may also act to secure the PCB to the housing module or by other suitable securement means. The double Fresnel lens 50 is then positioned within the housing module 102 in alignment with but spaced apart from the distributed lens array 76. In this example, an edge 156 of the vertical sidewall 140 of the housing module 102 acts as a shelf 158 in which an outer portion 160 of the double Fresnel lens 50 is placed on the shelf 158 to hold the double Fresnel lens 50 at a spaced apart distance from the distributed lens array 76 such that the distributed lens array 76 is disposed between the LED array 66 and the double Fresnel lens 50. An inner wall 162 of the rim 116 is disposed about the double Fresnel lens 50 to further hold the double Fresnel lens 50 in place as it is seated on the shelf 158 of the housing module 102. Additionally, the double Fresnel lens 50 has a pair of cut-out portions 164 that respectively align with a pair of alignment tabs 166 extending inward from the rim 116 of the housing module 102. The alignment tabs 166 are configured to align with the respective cut-out portions 164 upon insertion of the double Fresnel lens 50 into the housing module 102. In this example, the cut-out portions 164 and the alignment tabs 166 are both rounded (e.g., half-moon) in shape such that they align with one another. The use of the cut-out portions 164 and respective alignment tabs 166 ensure that the double Fresnel lens 50 is properly placed within the housing module 102 and prevents rotation of the double Fresnel lens 50 within the housing module 102.

As seen, the double Fresnel lens 50 has a first pattern of Fresnel features 54 disposed on one side of the lens substrate 52 and a second pattern of Fresnel features 58 disposed on an opposite side of the substrate 52. In this example, the second pattern of Fresnel features 58 is perpendicular to and different from the first pattern of Fresnel features 54. Additionally, the first pattern of Fresnel features 54 has a focal length L that is different from the formal length L2 of the second pattern of Fresnel features 58. As noted above, the individual LEDs 67 of the LED array 66 may be spaced equal to and in alignment with the lenslets 74 of the double Fresnel lens 50, FIG. 3.

Figure 10:
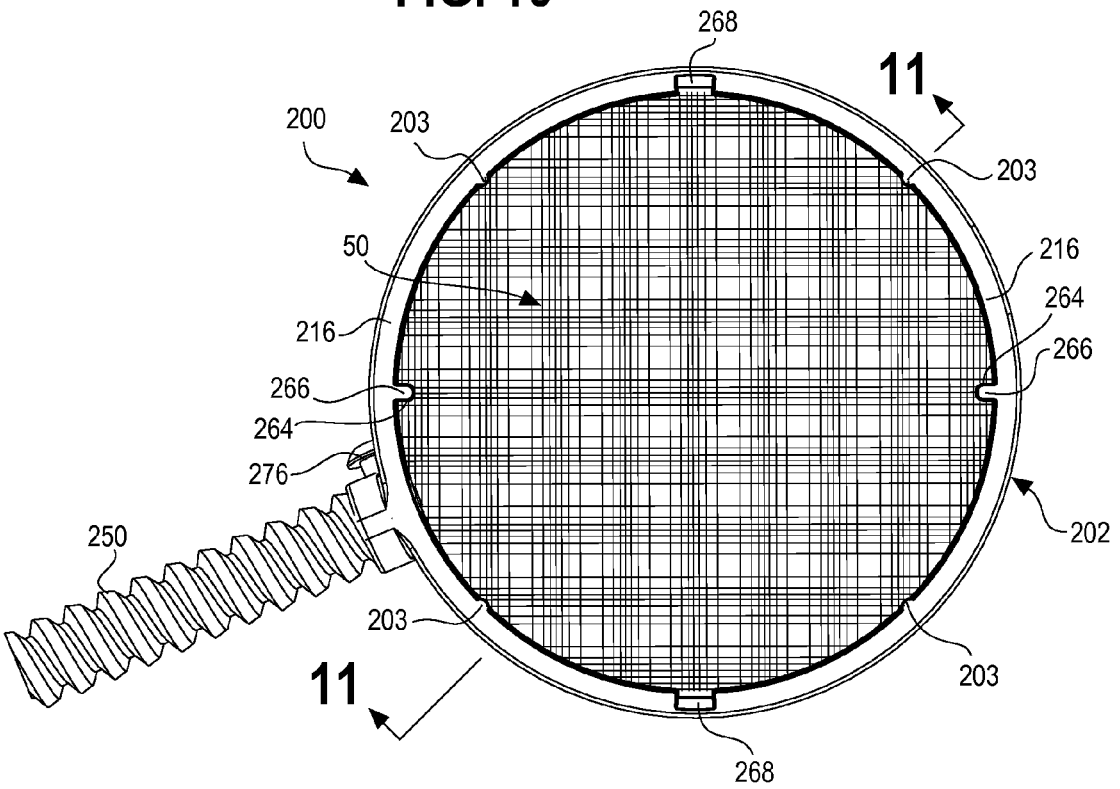
FIG. 10 is a plan view of another embodiment of a lighting device module.

Referring now to FIG. 10, an alternative embodiment of a lighting device module 200 is shown with the rim 216 of housing module 202 having retainer members 203 used to retain the double Fresnel lens 50 within the housing module 202. In this embodiment, the double Fresnel lens 50 has cut-out portions 264 that mate with respective alignment tabs 266 extending from the rim 216 of the housing module 202 to ensure proper insertion and prevent rotation of the double Fresnel lens 50 within the housing module 202. Additionally, a pair of clearance regions 268 are formed in the rim member 216 of the housing module 202 to allow for the insertion of a tool 270 for the removal of the double Fresnel lens 50 from the housing module 202 (See also FIG. 19). In this embodiment, conduit 250, FIG. 10, is inserted into a conduit entry 272 having an aperture 274 extending from vertical sidewall 240 of the housing member 202 (See also FIG. 12). Once inserted, the conduit 250 is secured to the conduit entry 272 by set screw 276 or other suitable securement apparatus.

Figure 11:
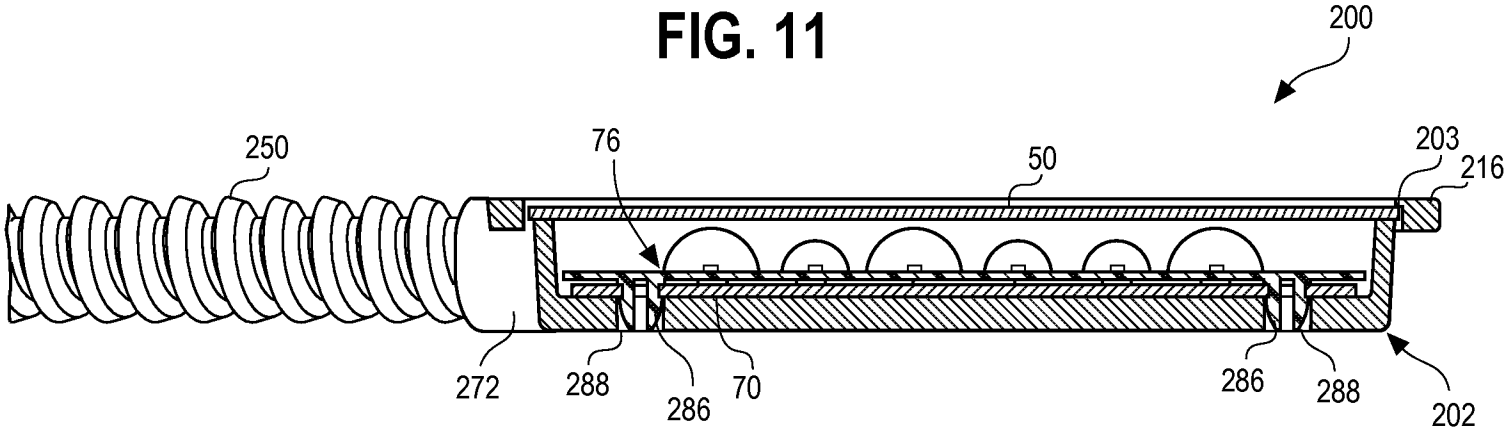
FIG. 11 is a cross-sectional view of the lighting device module of FIG. 10 along line 11-11.
Figure 12:
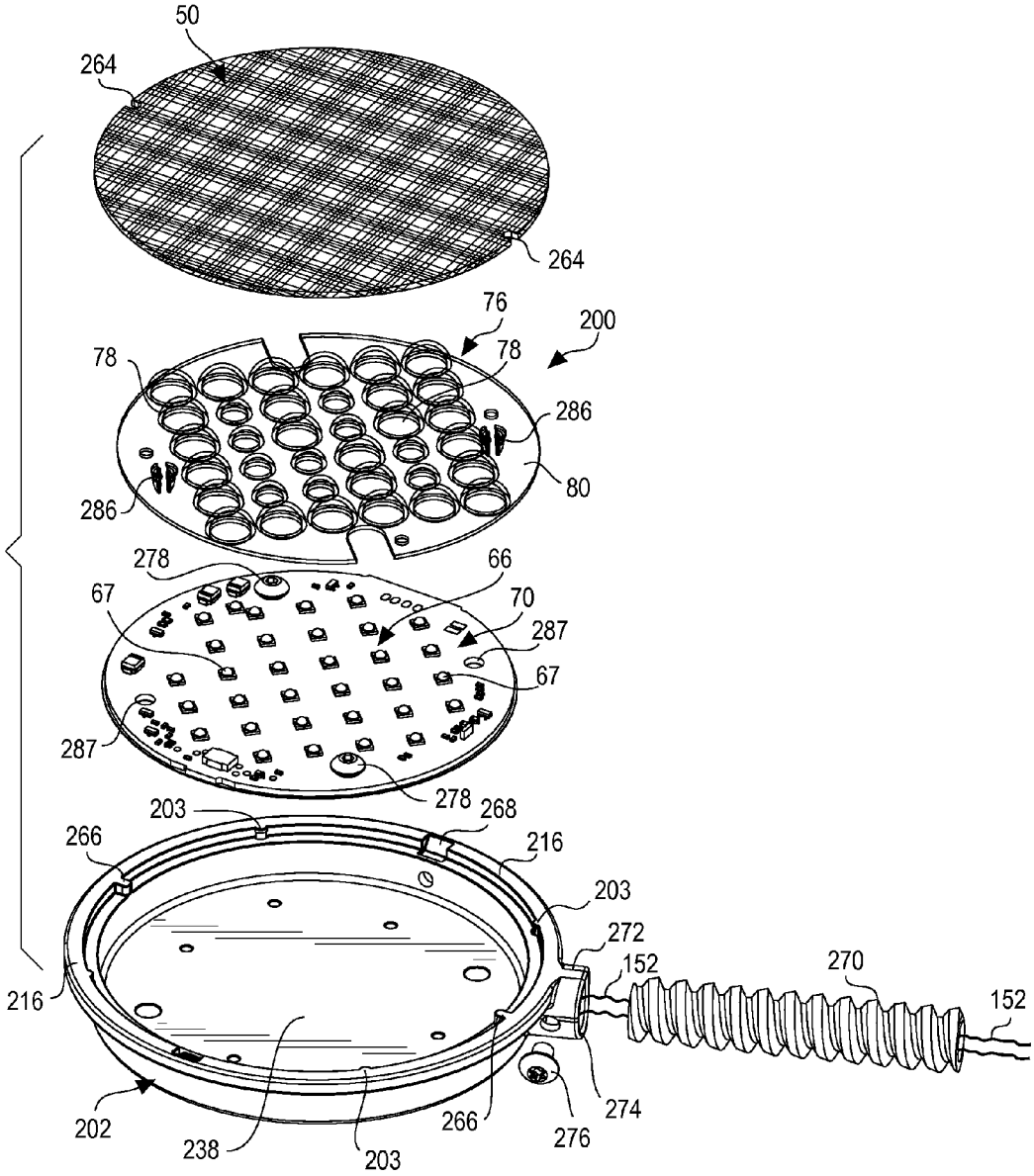
FIG. 12 is an exploded isometric view of the lighting device module of FIG. 10.
Figure 13:
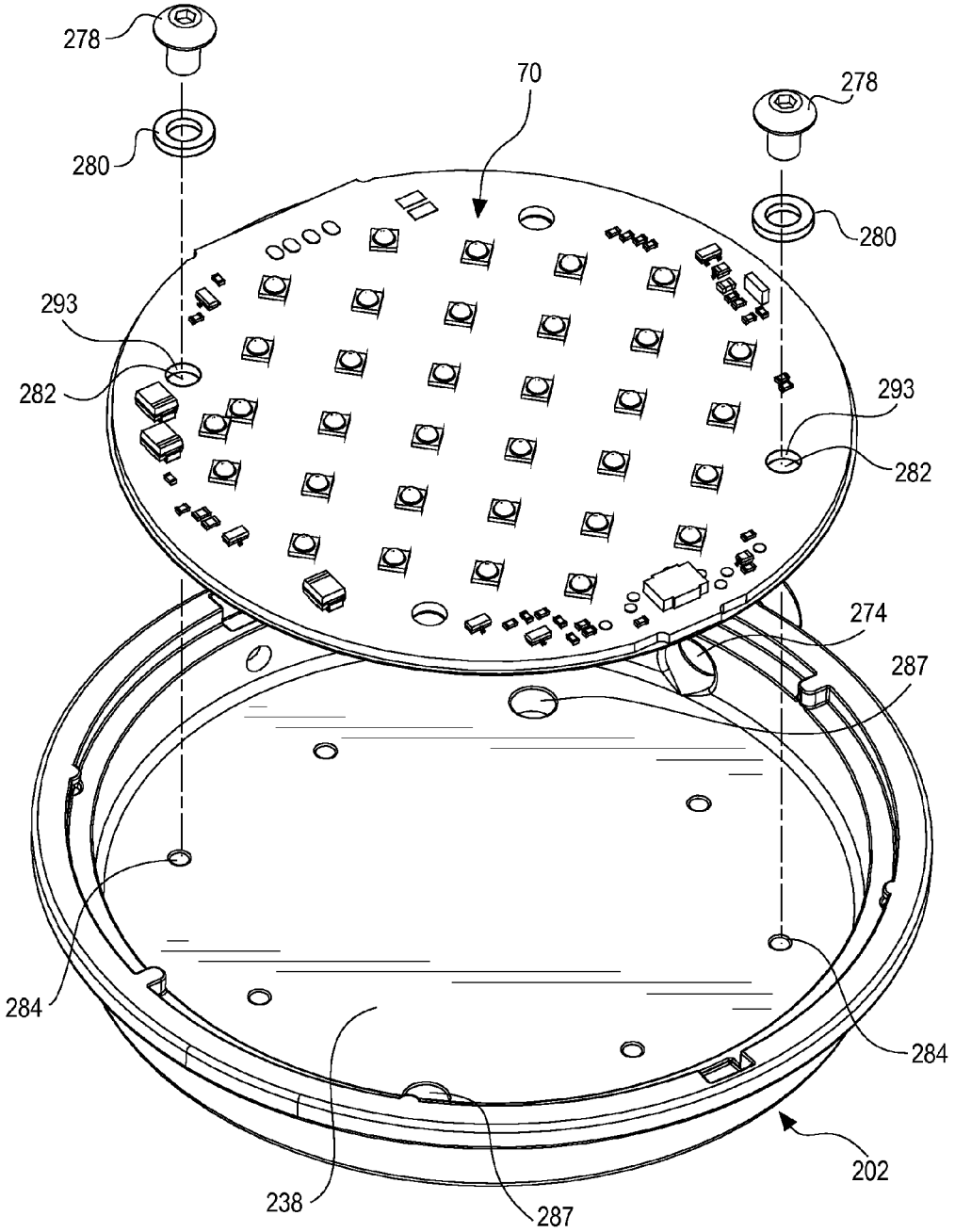
FIG. 13 is an exploded isometric view of a housing module and printed circuit board (PCB) of the lighting device module of FIG. 10.
Figure 14:
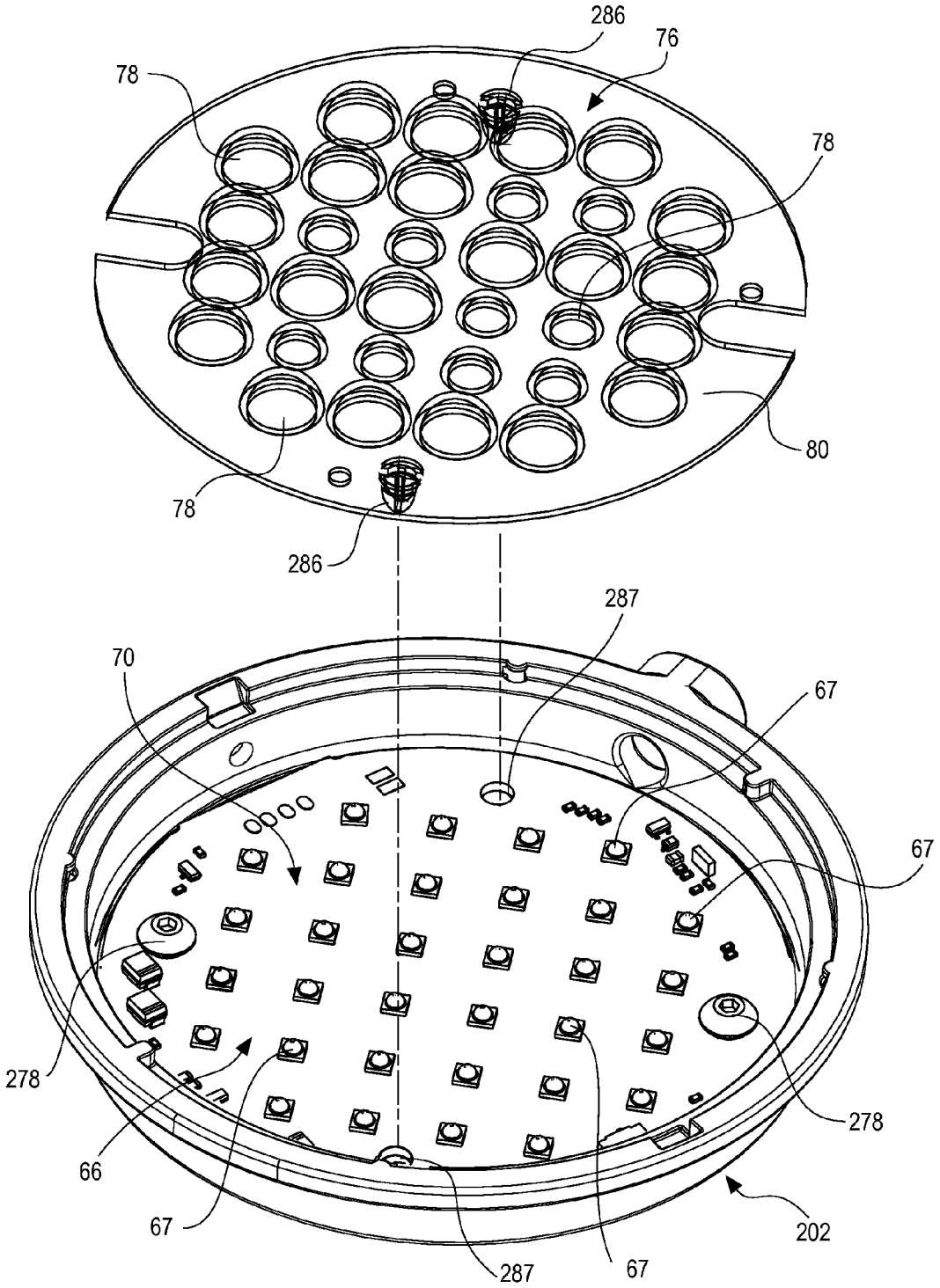
FIG. 14 is an exploded isometric view illustrating insertion of a distributed lens to the housing module of the lighting device module of FIG. 10.

Referring to FIGS. 11 and 12, the lighting device module 200 has housing module 202, that holds in a compact self-contained package the PCB 70 having an array of LEDs 66, distributed lens array 76, and the optical double Fresnel lens 50. Assembly of the lighting device module 200 includes fastening the PCB 70 to the housing module 202. As seen in FIG. 13, the PCB 70 may be fastened to mounting wall 238 of the housing module 202, in this example, with a pair of machine screws 278 and washers 280. Bores 282 through the PCB 70 are aligned with respective insertion holes 284 in the mounting wall 238 allowing for insertion and securement of the machine screws 278 thereto. As seen in FIG. 14, once the PCB 70 is secured, the distributed lens array 76 is positioned over the PCB 70 and fastened within the housing module 202. In this example embodiment, the distributed lens array 76 has a pair of resilient engagement members 286 extending from the base plate 80 (See FIGS. 11-12 and 14-15). The resilient engagement members 286 are insertable through the PCB 70 via respective bores 287 which receive the corresponding resilient engagement member 286, FIGS. 12, 14. The resilient engagement members 286 are inserted through bores 287 of the PCB 70 to a recess area 288 (FIGS. 11, 15) of the housing module 202 for snap fit engagement of the distributed lens 76 within the housing module.

Figure 15:
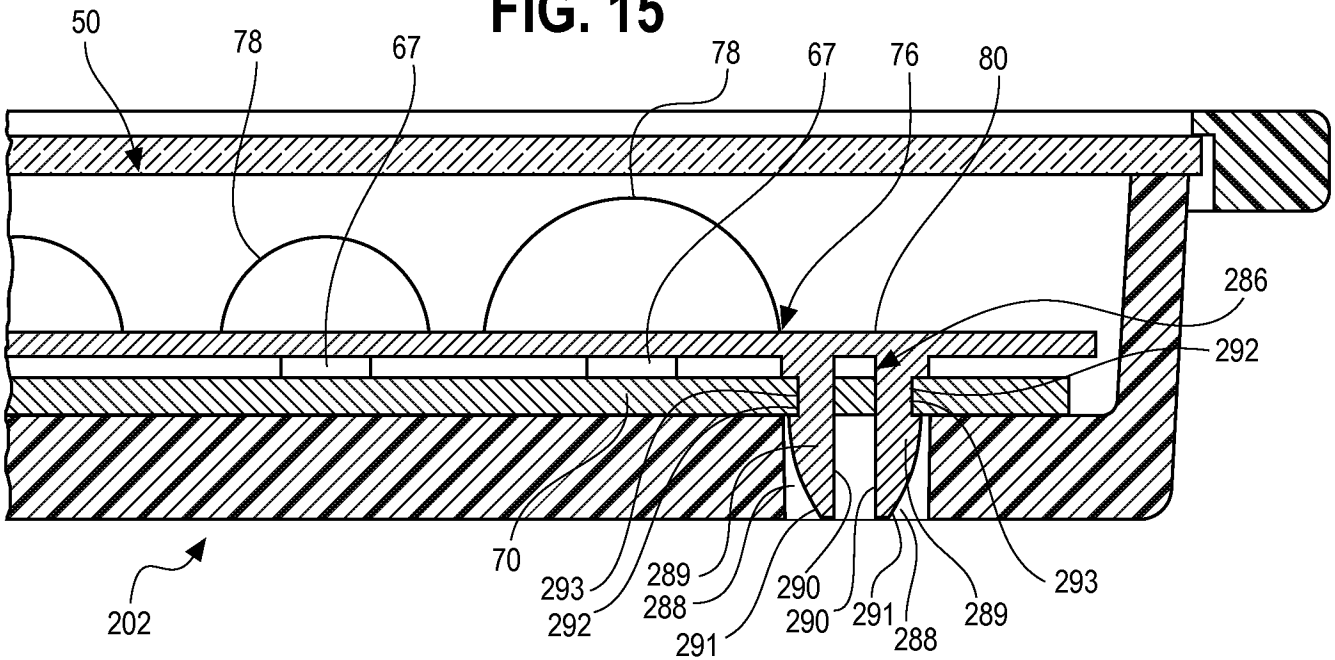
FIG. 15 is an enlarged partial sectional view of the lighting device module of FIG. 10.

As seen in FIG. 15, each resilient engagement member 286, in this example embodiment, has a pair of resilient leg members 289. The leg members 289 extend from the base plate 80 of the distributed leans 76. The pair of leg members 289 each have a straight wall 290 that face one another and a curved surface 291 and a notch 292 which face outward. As the curved surfaces 291 of the leg members 289 are inserted through bores 287 of PCB 70 the leg members 289 resiliently bend inwards. Once the curved surfaces 291 of the leg members 289 have been received in the recess area 288 of the housing module 202, legs 289 of the resilient engagement member 286 snap back into place and the notches 292 of each leg 289 are engaged in a locking arrangement with a wall 293 of the corresponding bore 287 inserted thereto. This provides a snap fit engagement of the distributed lens array 76 within the housing module 202 with the hemispherical lenses 78 of the distributed array positioned over respective LEDs 67 on the PCB 70.

Figure 16:
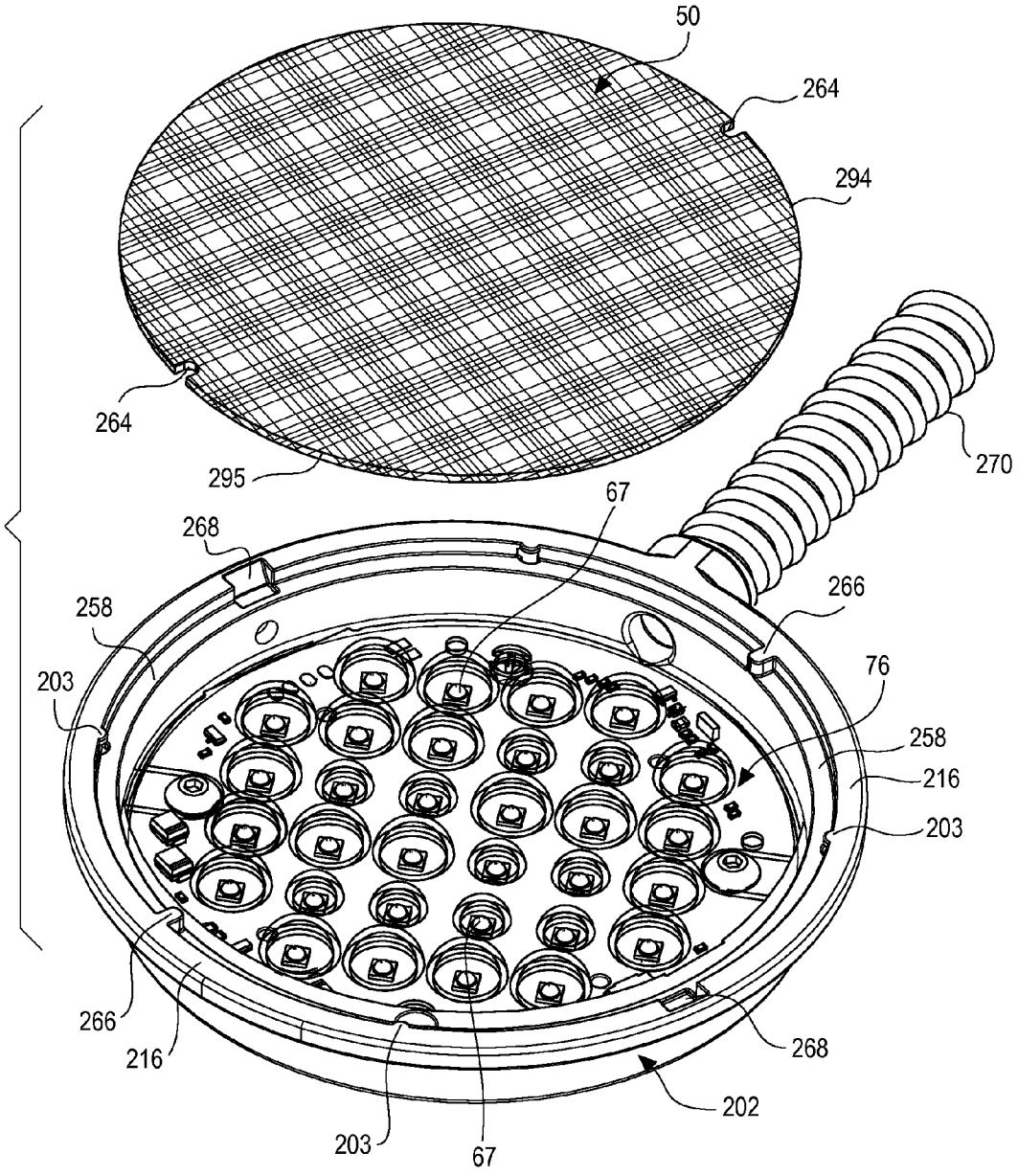
FIG. 16 is an exploded isometric view illustrating insertion of an optical lens to the housing module of the lighting device module of FIG. 10.
Figure 17:
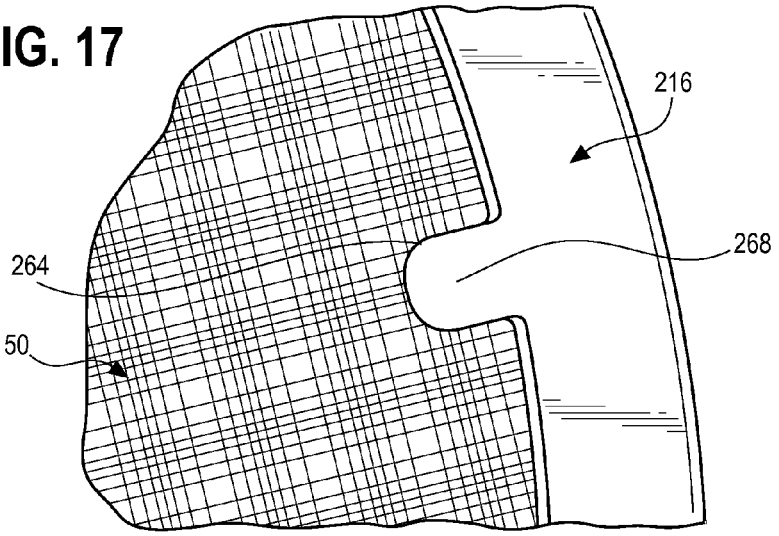
FIG. 17 is a partial plan view of the lighting device module of FIG. 10 illustrating an alignment member of the housing module.
Figure 18A:
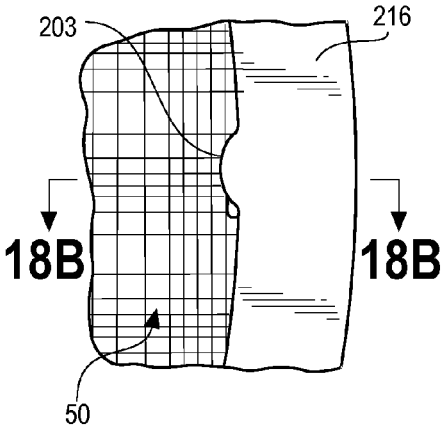
FIG. 18A is a partial plan view of the lighting device module of FIG. 10 illustrating a retaining member of the housing module.
Figure 18B:
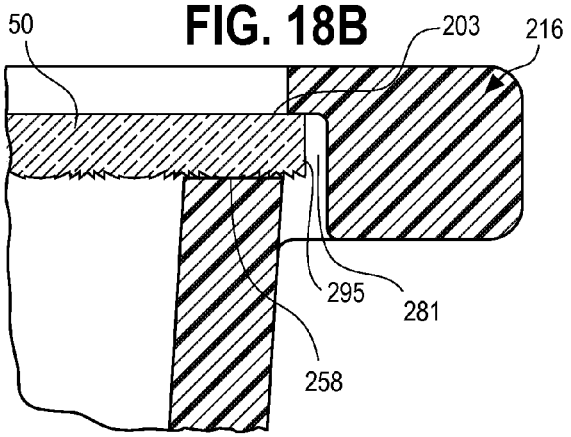
FIG. 18B is a partial sectional view taken along line 18B-18B of FIG. 18A.

Referring to FIG. 16, after the distributed lens array 76 has been fastened into place, the double Fresnel lens 50 may be secured to within the housing module 202 with the double Fresnel lens 50 positioned to be aligned with and spaced apart from the distributed lens array 76. The cut-out portions 264 of the double Fresnel lens 50 are aligned with mating alignment tabs 266 extending from the rim 216 of the housing module 202, FIGS. 16 and 17. As seen in FIGS. 16, 18A and 18B, the housing module 202 has a shelf member 258 which supports an outer area 294 of the double Fresnel lens 50 in the housing module 202 and a plurality of retainer members 203 to retain the double Fresnel lens within the housing module 202. In this example, four retainer members are spaced apart approximately 90° from one another about the rim 216 of the housing module 202. A different number of retainer members and spacing arrangements may selectively be used for holding the double Fresnel lens in place. The retainer members 203 may be small tabs which extend slightly from the rim 216 and have an open space 281 for receipt of the edge 295 of the double Fresnel lens 50 such that the double Fresnel lens 50 may be snap fitted into each of the four locations of the retainer members 203. The outer edge of the double Fresnel lens 295 is disposed between the vertical sidewall shelf 258 of the housing module and the retainer members 203 allowing the retainer members 203 to retain the double Fresnel lens 50 within the housing module 202.

Figure 19:
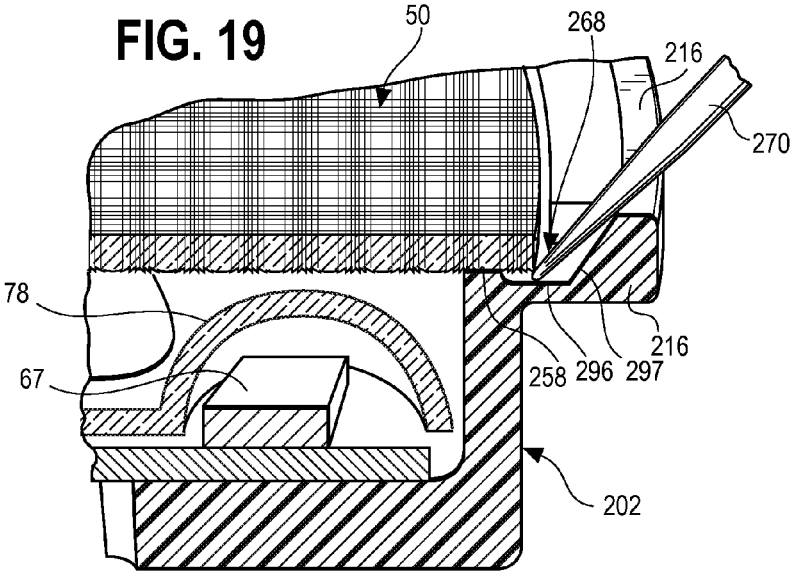
FIG. 19 is a partial sectional view of the lighting device module of FIG. 10.

As seen in FIGS. 10 and 19, clearance regions 268 are also formed in the rim member 216 of the housing module 202. The clearance region 268, in this example, has a generally horizontal wall 296 that is spaced slightly below the shelf wall 258 holding the double Fresnel lens 50 in position. An angled wall 297 extends outward from the generally horizontal wall 296 of the clearance region 296 to allow a tool 270 to be inserted at an angle to reach underneath the held double Fresnel lens 50. The clearance at the horizontal wall 296 allows the tool to reach underneath an edge of the double Fresnel lens 50 to remove the double Fresnel lens from the housing module 202 upon a slight upward movement of the tool 270.

INDUSTRIAL APPLICABILITY

In summary, it has been found that when using a single color or multicolor LED element in a luminaire, it is desirable to mix the light output developed by the LEDs thoroughly so that the intensity and/or color appearance emitted by the luminaire is uniform. Opportunities have been found to exist to accomplish such mixing using a double Fresnel lens. Specifically, the multiple collimations provided by the use of a plurality of overlaid Fresnel patterns results in improved collimation and light mixing. The distance between the double Fresnel lens and the light source affect the degree of mixing. Also, the profiles of the Fresnel patterns may have the same or different curvature; they may be equally or unequally spaced, etc. The double Fresnel lens of any of the embodiments disclosed herein may be planar, non-planar, irregular-shaped, curved, other shapes, suspended, a lay-in or surface mount waveguide, etc.

While specific double Fresnel lens feature parameters including shapes, sizes, locations, orientations relative to a light source, materials, etc. are disclosed as embodiments herein, the present invention is not limited to the disclosed embodiments, inasmuch as various combinations and all permutations of such parameters are also specifically contemplated herein. Thus, any of the double Fresnel lens, the LED elements, the distributed lens array, etc. as described herein may be used in a luminaire, either alone or in combination with one or more additional elements, or in varying combination(s) to obtain light mixing and/or a desired light output distribution. Other luminaire form factors than those disclosed herein are also contemplated.

The double Fresnel lens disclosed herein efficiently collimates and uniformly mixes light emitted from the light device. Example luminaires disclosed herein may be particularly adapted for use in installations, such as, replacement or retrofit lamps (e.g., LED PAR bulbs), outdoor products (e.g., streetlights, high-bay lights, canopy lights), and indoor products (e.g., True white module, downlights, truck lights, tracklights, troffers, a lay-in or drop-in application, a surface mount application onto a wall or ceiling, etc.) preferably requiring a total luminaire output of at least about 8,000 lumens or greater.

When one uses a relatively small light source which emits into a broad (e.g., Lambertian) angular distribution (common for LED-based light sources), the conservation of etendue, as generally understood in the art, requires an optical system having a large emission area to achieve a narrow (collimated) angular light distribution. In the case of parabolic reflectors, a large optic is thus generally required to achieve high levels of collimation. In order to achieve a large emission area in a more compact design, the prior art has relied on the use of Fresnel lenses, which utilize refractive optical surfaces to direct and collimate the light. In the present disclosure, the use of two perpendicular Fresnel patterns on a lens spaced apart from an LED array allows the full range of angular emission from the source, including high-angle light, to be re-directed and collimated.

All references, including publications, patent applications, and patents, cited herein are hereby incorporated by reference to the same extent as if each reference were individually and specifically indicated to be incorporated by reference and were set forth in its entirety herein.

In some embodiments, one may wish to control the light rays such that at least some of the rays are collimated, but in the same or other embodiments, one may also wish to control other or all of the light rays to increase the angular dispersion thereof so that such light is not collimated. In some embodiments, one might wish to collimate to narrow ranges, while in other cases, one might wish to undertake the opposite.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. An optical lens comprising:

a substrate comprising a first side and a second side opposite the first side;

a first pattern of Fresnel features comprising a first focal length disposed on the first side; and a second pattern of Fresnel features comprising a second focal length disposed on the second side;

wherein the first pattern of Fresnel features is disposed perpendicular to the second pattern of Fresnel features, and wherein the first focal length is different from the second focal length.

2. The optical lens of claim 1, wherein the first and second patterns of Fresnel features are linear.

3. The optical lens of claim 2, wherein the first and second patterns of Fresnel features create a grid-like array of lenslets.

4. The optical lens of claim 3, wherein at least one lenslet is configured to align with the light of an LED.

5. The optical lens of claim 1, wherein the first and second focal lengths range from 0.5 to 2.0 times the spacing distance between LEDs of an LED array.

6. The optical lens of claim 1, wherein the first and second focal lengths are based on the distance from a light source to respective first and second patterns of Fresnel features.

7. The optical lens of claim 1, wherein the first and second patterns of Fresnel features are separated by a thickness of the substrate.

8. The optical lens of claim 1, wherein the substrate is formed from a translucent material.

9. The optical lens of claim 1, wherein the substrate is comprised of one of acrylic, air, molded silicone, polycarbonate, glass, cyclic olefin copolyments, and combinations thereof.

10. The optical lens of claim 1, wherein the first pattern of Fresnel features and the second pattern of Fresnel features are formed and disposed on the substrate by one of the following methods: embossing; molding; screen printing; machining; laser-forming; and laminating.

11. The optical lens of claim 1, wherein the first pattern of Fresnel features comprises repeating units of Fresnel features extending along the substrate in a first direction, and the second pattern of Fresnel features comprises repeating units of Fresnel features extending along the substrate in a second direction, perpendicular to the first direction.

12. The optical lens of claim 1, wherein each unit of Fresnel features of the first and second patterns comprises a convex lens and shifting cut sections of convex lenses, which are disposed on opposite sides of the convex lens.

13. A lighting device comprising:

a housing;

an LED array disposed in the housing; and an optical lens disposed adjacent to the LED array comprising a substrate comprising a first pattern of Fresnel features disposed on a first side of the substrate, and a second pattern of Fresnel features disposed on a second side of the substrate opposite the first side, wherein the first pattern of Fresnel features is perpendicular to and different from the second pattern of Fresnel features.

14. The lighting device of claim 13, wherein the first and second patterns of Fresnel features create a grid-like array of lenslets.

15. The lighting device of claim 14, wherein the LED array is a linear matrix of individual LEDs with equal spacing to and in alignment with the lenslets.

16. The lighting device of claim 14, wherein the distance between the LED array and the optical lens ranges from 0.5 to 2.0 times the spacing distance between individual LEDs of the LED array.

17. The lighting device of claim 14, wherein the first pattern of Fresnel features comprises a first focal length and the second pattern of Fresnel features comprises a second focal length, wherein the first focal length is different from the second focal length.

18. The lighting device of claim 15, wherein the size and number of lenslets of the optical lens correspond to and align with the size and number of individual LEDs disposed on the LED array.

19. The lighting device of claim 15, further comprising a distributed lens, wherein the distributed lens comprises a plurality of lenses that extend from a base plate and receive the individual LEDs of the LED array.

20. The lighting device of claim 19, wherein the distributed lens is disposed adjacent the LED array such that an air gap is not formed between the distributed lens and the LED array.

21. The lighting device of claim 19, wherein the lenses of the distributed lens are curved in shape and comprise a diameter between 0.2 and 1.0 times the LED spacing of LEDs in the array.

* * * * *